US006790115B2

(12) United States Patent
Fukai et al.

(10) Patent No.: US 6,790,115 B2
(45) Date of Patent: Sep. 14, 2004

(54) ARC TUBE FOR DISCHARGE LAMP AND METHOD OF FABRICATING THE SAME

(75) Inventors: Kunio Fukai, Shizuoka (JP); Akihiro Nagata, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 123 days.

(21) Appl. No.: 09/988,670

(22) Filed: Nov. 20, 2001

(65) Prior Publication Data

US 2002/0063529 A1 May 30, 2002

(30) Foreign Application Priority Data

Nov. 24, 2000 (JP) ..... P. 2000-358235

(51) Int. Cl.[7] ..... H05B 33/10
(52) U.S. Cl. ..... 445/26; 445/27; 445/44
(58) Field of Search ..... 445/26, 27, 22, 445/23, 44; 313/493, 634, 613, 492, 623

(56) References Cited

U.S. PATENT DOCUMENTS

| | | | | |
|---|---|---|---|---|
| 5,877,591 A | | 3/1999 | Nagata et al. | 313/634 |
| 5,936,349 A | | 8/1999 | Fukai et al. | 313/623 |
| 6,287,163 B2 | * | 9/2001 | Tanaka et al. | 445/22 |
| 6,354,900 B1 | * | 3/2002 | Ohshima et al. | 445/26 |
| 6,547,619 B1 | * | 4/2003 | Ohkawai et al. | 445/26 |
| 6,580,200 B2 | * | 6/2003 | Fukuyo et al. | 313/25 |

OTHER PUBLICATIONS

Takagaki et al (U.S. 2003/0062839) "Mercury–Free Arc Tube for Discharge Lamp Unit" Apr. 3, 2003.*
Tsuda et al (U.S. 2002/0063503) "Discharge Bulb" May 30, 2002.*

* cited by examiner

*Primary Examiner*—Dean A. Reichard
*Assistant Examiner*—Angel R. Estrada
(74) *Attorney, Agent, or Firm*—Sughrue Mion, PLLC

(57) ABSTRACT

An arc tube and method of fabricating the arc tube for a discharge lamp. The arc tube includes an arc tube main body 10 at which a sealed glass bulb 12 serving as a discharge portion sandwiched by pinch seal portions is formed at a portion of a glass tube W along the longitudinal direction thereof, and a cylindrical shroud glass 20 which is welded on and integrated with the arc tube main body 10 so as to cover the sealed glass bulb 12, the front and rear end portions of the shroud glass 20 may be joined, for example, by welding on shroud glass welded portions with circular cross sections provided at the front and rear end sides of the arc tube main body 10, respectively. The inner peripheral surface of the diameter reduced portion of the shroud glass tube 20, which is molten, soften and deformed inside along the radial direction, contacts closely to the circular outer peripheral surface on the arc tube main body 10 side, so that a space can not be formed at the welding portion of the shroud glass 20 (adhesion surface). Thus, the atmosphere does not enter into the sealed space 24 surrounded by the shroud glass 20, and accordingly, devitrification is prevented.

9 Claims, 12 Drawing Sheets

P
A'
c
b
a
36
W1
W
12
A
13b
16
14b
c

ARC TUBE FOR DISCHARGE LAMP AND METHOD OF FABRICATING THE SAME

BACKGROUND OF THE INVENTION

1. Field of the Invention

The present invention relates to an arc tube, and a method of fabricating the arc tube for a discharge lamp in which a cylindrical shroud glass is welded on and integrated with an arc tube main body having a sealed glass bulb that serves as a discharge portion and is formed at a portion of the main body along the longitudinal direction thereof.

2. Description of the Related Art

Conventionally, as shown in FIG. 12, an arc tube is configured in a manner that a cylindrical shroud glass 8 for shielding ultraviolet rays is welded on and integrated with an arc tube main body 1 having a sealed glass bulb 2 which serves as a discharge portion and is formed at a portion of the main body along the longitudinal direction thereof, and the sealed glass bulb 2 is covered by the shroud glass 8. Reference numerals 8*a*, 8*b* depict welding portions of the shroud glass 8.

Electrodes a, a are provided in an opposite manner within the sealed glass bulb 2 sandwiched between the pinch seal portions 3*a*, 3*b*, and lead wires c, c coupled to molybdenum foils b, b are drawn from the pinch seal portions 3*a*, 3*b* at both ends of the glass bulb, respectively. Cylindrical portions 4*a*, 4*b* as non-pinch seal portions are formed at the front and rear portions of the pinch seal portions 3*a*, 3*b* so as to be extracted therefrom, respectively.

The shroud glass 8 cuts ultraviolet rays in a wavelength range that may be harmful to the human body among light emitted from the sealed glass bulb 2.

A sealed space 7, formed by the shroud glass 8 and surrounding the arc tube main body 1, suppresses devitrification generated at the arc tube. That is, since the lamp room in which the arc tube is disposed communicates with the outside of the lamp room through an air hole performing breathing operation, and the atmosphere within the lamp room contains a lot of moisture, the moisture causes the devitrification generated at the arc tube. Therefore, the arc tube main body 1 is covered by the sealed space 7 so that the arc tube main body 1 does not contact the atmosphere containing the moisture, thereby suppressing the generation of the devitrification.

In order to fabricate the arc tube shown in FIG. 12, first, the rod-shaped arc tube main body 1 having cylindrical portions 4*a*, 4*b* formed at both ends thereof is fabricated. Thereafter, the arc tube main body 1 is inserted within a shroud glass tube 9, then the front and rear end sides of the shroud glass tube 9 are heated to be molten and softened. After that, the softened portions are deformed by using forming rolls in a direction for reducing the diameter of the shroud glass tube (a direction shown by the arrows in FIG. 12) and pressed against the pinch seal portions 3*a*, 3*b* of the arc tube main body 1 at the inside of the glass tube and welded at the pinch seal portions. Then, the shroud glass tube 9 is cut at predetermined portions as necessary.

However, according to the conventional arc tube described above, there arises a problem that the devitrification phenomenon occurs despite the fact that the shroud glass 8 (the shroud glass tube 9) is welded to the arc tube main body 1 to form the sealed space 7.

The inventors of the present invention inspected the cause of the occurrence of the devitrification phenomenon and determined that the cause resides in the sectional shape of the arc tube main body (the pinch seal portions 3*a*, 3*b*) for welding the shroud glass 8 thereon. That is, although the cross section of the shroud glass tube 9 is cylindrical, the cross section of the pinch seal portion 3*a* (3*b*) is rectangular as shown in FIG. 13(*a*) since it is typically pinched by a pincher. Thus, in the welding process of the shroud glass, as shown by a phantom line in FIG. 13(*a*), when the shroud glass tube 9, which is molten and softened and pressed in the direction for reducing the diameter thereof along its radius direction, contacts closely to the surface (flat surface) of the pinch seal portion 3*a*, an opening S extending in the axial direction along the contact surface is formed (see FIG. 13(*b*)). As a result, the atmosphere (moisture) within the lamp room enters into the sealed space 7 around the arc tube main body 1 from the opening S formed at the welded portion, thereby causing devitrification.

SUMMARY OF THE INVENTION

The inventors of the present invention have determined that an opening is not formed at the contact surface between the arc tube main body 1 and the shroud glass 8 when the welded portion of the shroud glass at the arc tube main body 1 is formed in a circular shape in its cross section.

Accordingly, an object of the present invention is to provide an arc tube for a discharge lamp and a method for fabricating the arc tube in which the welded portion of the shroud at an arc tube main body is formed in a circular shape in its cross section thereby preventing the forming of an opening at the contact surface between the arc tube main body and the shroud glass.

In order to attain the aforesaid object, an arc tube for a discharge lamp according to the present invention is arranged in a manner such that the arc tube includes an arc tube main body at which a sealed bulb, for example, a glass bulb, serving as a discharge portion sandwiched by front and rear pinch seal portions is formed at a portion of a tube along a longitudinal direction thereof, and a cylindrical shroud which is welded on and integrated with the arc tube main body so as to cover the sealed bulb to form an airtight sealed space around the arc tube main body, the front and rear end portions of the shroud are welded on shroud weld portions with circular cross sections provided at front and rear end sides of the arc tube main body, respectively. In the embodiments described herein, the shroud may be formed of glass, and the arc tube body may be formed from a glass tube. of course, other materials known to those skilled in the art may be substituted without departing from the scope of the present invention.

A method of fabricating an arc tube for a discharge lamp according to the present invention includes an arc tube main body fabricating process for fabricating an arc tube main body at which a sealed glass bulb serving as a discharge portion sandwiched by front and rear pinch seal portions is formed at a portion of a glass tube along a longitudinal direction thereof, and a shroud glass welding process for welding and integrating a cylindrical shroud glass on and with the arc tube main body so as to cover the sealed glass bulb, wherein in the arc tube main body fabricating process, shroud glass welded portions with circular cross sections are formed on front and rear end sides of the arc tube main body, respectively, and in the shroud glass welding process, the arc tube main body is inserted into the shroud glass tube, predetermined positions of the shroud glass having been heated, molten and softened are modified in a direction of reducing diameters thereof, and the predetermined positions are welded on the shroud glass welded portions on the front and rear end sides of the arc tube main body, respectively.

At the time of welding the shroud glass to the arc tube main body, the predetermined positions of the shroud glass tube having been heated, molten and softened are modified inside so as to reduce their diameter in a radial direction. As shown in FIG. 9 (a diagram showing a state where the shroud glass is shrink-sealed) in an embodiment of the invention, each of the outer peripheral surfaces of the shroud glass welded portion of the arc tube main body (a shrink seal portion 15*a* and a cylindrical portion 14*a*) and the inner peripheral surface of the molten diameter-reduced area of the shroud glass tube 20 may have a circular shape almost matching to each other. Thus, the inner peripheral surface of the molten diameter-reduced portion of the shroud glass tube 20 is molten and welded on the outer peripheral surface of the shroud glass welded portion of the arc tube main body (the shrink seal portion 15*a* and the cylindrical portion 14*a*) uniformly along the peripheral direction thereof without causing any space therebetween, so that such a space for releasing the sealed space around the arc tube main body to the atmosphere is not formed at the welding portion between the arc tube main body and the shroud glass tube.

In particular, when inactive gas, adjusted to be a negative pressure such that a pressure becomes about 1 atm. upon lighting and heating the arc tube, is supplied within the airtight sealed space formed around the arc tube main body, the arc tube main body is prevented from contacting moisture in the atmosphere.

Further, in a method of fabricating an arc tube according to the present invention, in the arc tube main body fabricating process, a cylindrical non-pinch seal portion is formed in an extended manner at a backward portion of the pinch seal portion on the rear end side of the arc tube main body, and a shrink seal portion is formed adjacent to a forward portion of the pinch seal portion on the front end side of the arc tube main body, and in the shroud glass welding process, the rear end side of the shroud glass tube is welded on the cylindrical non-pinch seal portion on the rear end side of the arc tube main body, and the front end side of the shroud glass tube is welded on the shrink seal portion on the front end side of the arc tube main body.

At the rear end portion of the shroud glass, the circular inner peripheral surface on the rear end side of the shroud glass tube which is molten, softened and modified in a direction of reducing the diameter thereof matches almost with the outer peripheral surface of the cylindrical non-pinch seal portion on the arc tube main body side, and so the inner peripheral surface of the molten shroud glass is molten and adhered to the outer peripheral surface of the non-pinch seal portion uniformly along the peripheral direction thereof without causing any space therebetween.

In contrast, at the front end portion of the shroud glass, since the outer peripheral surface of the shrink seal portion has a circular shape, the circular inner peripheral surface on the front end side of the shroud glass tube which is molten, softened and modified in a direction of reducing the diameter thereof adheres to the circular outer peripheral surface of the shrink seal portion on the arc tube main body side uniformly along the peripheral direction thereof without causing any space therebetween.

Incidentally, the welded portion with a circular cross section on the front end side of the arc tube main body may be, for example, a cylindrical portion (see FIG. 11) serving as a non-pinch seal portion extending forward of the front end side pinch seal portion; a pinch seal portion with a circular cross section provided adjacent to the forward portion of the front end side pinch seal portion with a rectangular cross section; a shrink seal portion provided adjacent to the forward portion of the front end side pinch seal portion; the pinch seal portion with the circular cross section and the cylindrical portion (see FIG. 10); or the shrink seal portion and the cylindrical portion (see FIG. 1). The shrink seal portion to which the shroud tube is welded can be formed in the following manner.

The arc tube main body may be fabricated in a manner that the predetermined filling material is supplied to the glass bulb of the glass tube which one end side is subjected to the primary pinch sealing, and thereafter the other side of the glass tube is subjected to the secondary pinch sealing. Then, the secondary pinch sealing process is performed in a manner that the seal expected area near the glass bulb is heated, molten and softened while the glass bulb of the glass tube is cooled by using cooling medium. In this respect, prior to the secondary pinch sealing using a pincher, the seal expected area having been heated, molten and softened deforms and shrinks in the diameter reducing direction due to the negative pressure within the glass tube (the negative pressure formed by condensing the filling material such as inactive gas etc. within the glass bulb) and so the shrink seal portion with the circular cross section is formed. In other words, the secondary pinch seal expected area of the glass bulb is entirely shrink-sealed. Then, the glass bulb side of the shrink seal portion is pinch-sealed with the predetermined width (a portion of the shrink seal portion closer to the glass bulb is pinch-sealed so that the shrink seal portion with the predetermined width remains), whereby the shrink seal portion with the circular cross section (shroud glass welded portion) is formed adjacent to the pinch seal portion with the rectangular cross section.

The width (length) of the shrink seal portion serving as the shroud glass welded portion may be in a range of L/6 to L/2, where L represents the entire length of the seal portion (that is, the pinch seal portion and the shrink seal portion). The inventors have determined that when the width is equal to or less than L/6, it becomes difficult to weld the shroud glass and a space is generated at the welding surface. In contrast, when the width is equal to or more than L/2, the length of the pinch seal portion becomes shorter, so that the property of the adhesion between the glass layer and the electrode assembly at the seal portion may be degraded and the airtightness of the sealed glass bulb may not be secured.

Further, in a method of fabricating an arc tube for a discharge lamp according to the invention, in the arc tube main body fabricating process, a cylindrical non-pinch seal portion provided with a circular flange portion on an outer periphery thereof is formed in an extended manner at a backward portion of the pinch seal portion on the rear end side of the arc tube main body, and in the shroud glass welding process, the rear end side of the shroud glass tube is welded on the circular flange portion on the rear end side of the arc tube main body.

The circular flange portion serving as the shroud glass welded portion is disposed closely to the inside of the rear end portion of the shroud glass tube, and the rear end portion of the shroud glass tube having been heated, molten and soften is molten and welded smoothly on the circular flange portion on the inside.

Also, the arc tube main body fabricating process may include a glass bulb forming process for forming a glass bulb at a portion of the glass tube; a primary pinch seal process for inserting an electrode assembly from one end side of the glass tube provided with the glass bulb and pinch-sealing a portion near the glass bulb; a sealing and exhausting process for supplying predetermined filling material such as mercury to the glass bulb, inserting an electrode ashy from the other end side of the glass tube and holding the ashy thereat, supplying inactive gas within the glass bulb and pinch-sealing or tipping off an opening end side of the glass tube to seal within the glass tube; and a secondary pinch seal process for pinch-sealing a portion of the glass tube near the glass bulb, the shroud glass welding process includes a process for welding the rear end side of the shroud glass tube on the rear end side of the arc tube main body, and a process of welding the front end side of the shroud glass tube on the front end side of the arc tube main body, in the secondary pinch seal process constituting the arc tube main body fabricating process, a seal expected area near the glass bulb is heated and molten to perform shrink sealing while cooling the glass bulb by using cooling medium, thereafter the glass bulb side of the shrink seal portion is pinch-sealed with a predetermined width to form a shrink seal portion adjacent to the pinch seal portion, in the shroud glass tube front end side welding process constituting the shroud glass welding process, a pressure within the shroud glass tube which rear end side being welded on the rear end side of the arc tube main body is kept at a negative pressure, a welding expected area on the front end side of the shroud glass tube is heated, molten and softened, and the front end side of the shroud glass tube is shrink-sealed to the shrink seal portion adjacent to the pinch seal portion.

In the secondary pinch seal process of the arc tube main body fabricating process, the seal expected area on the front end side of the glass tube having been heated, molten and softened deforms and shrinks in the diameter reducing direction due to the negative pressure within the glass tube (the negative pressure formed by condensing the filling material such as inactive gas, etc. within the glass bulb) and so the shrink seal portion with the circular cross section is formed. Then, the glass bulb side of the shrink seal portion is pinch-sealed thereby to form the shrink seal portion (shroud glass welded portion) adjacent to the forward portion of the pinch seal portion on the front end side of the arc tube main body.

In the shroud glass tube front end side welding process of the shroud glass welding process, the welding expected area of the shroud glass tube having been heated, molten and softened deforms and shrinks in the diameter reducing direction due to the negative pressure within the glass tube and is molten and welded on the shrink seal portion with the circular cross section (the shroud glass welded portion) on the front end side of the arc tube main body.

In addition, in the method of fabricating an arc tube, in the arc tube main body fabricating process, a cylindrical non-pinch seal portion is formed in an extended manner at a forward portion of the pinch seal portion on the front end side of the arc tube main body, and in the shroud glass welding process, the front end side of the shroud glass tube is welded on only the cylindrical non-pinch seal portion on the front end side of the arc tube main body or on a welded portion with a circular cross section including the cylindrical non-pinch seal portion.

Since the front end side of the shroud glass tube is welded on the cylindrical non-pinch seal portion on the front end side of the arc tube main body, the axial length of the welding surface can be made larger.

BRIEF DESCRIPTION OF THE DRAWINGS

FIG. 1(*b*) is a longitudinal sectional view of the arc tube.

FIG. 1(*c*) is a cross sectional view at a position of the shrink seal portion of the arc tube (a sectional view along a line I—I shown in FIG. 1(*b*)

DETAILED DESCRIPTION OF THE INVENTION

The embodiments of the invention are explained below with reference to the accompanying drawings.

Figure 1A:
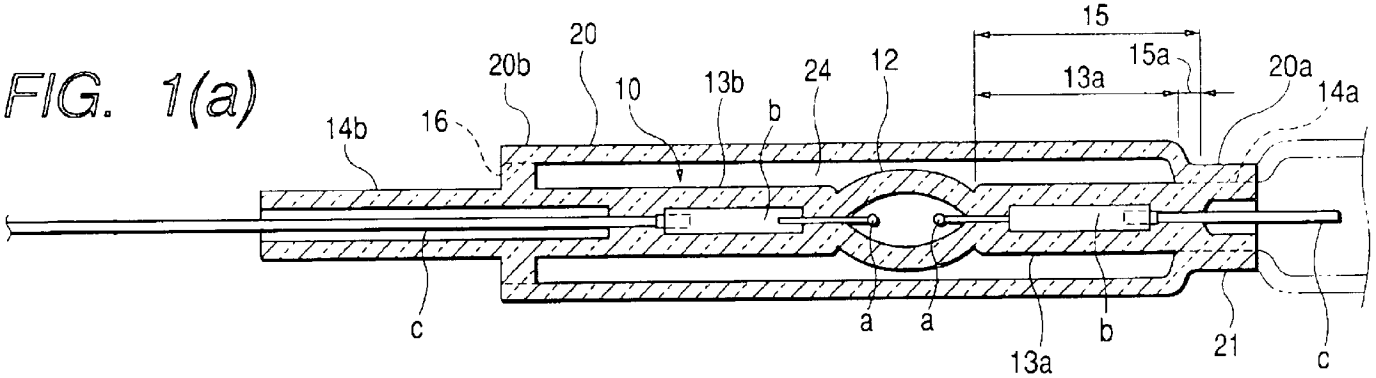
FIG. 1(*a*) is a horizontal sectional view of an arc tube according to an embodiment of the invention.
Figure 1B:
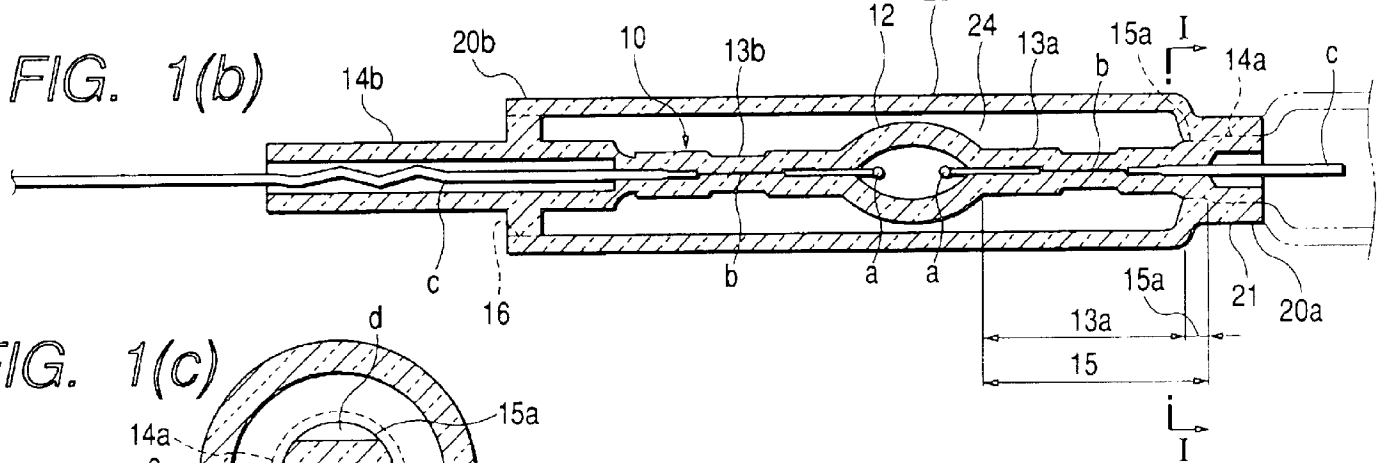
Figure 1C:
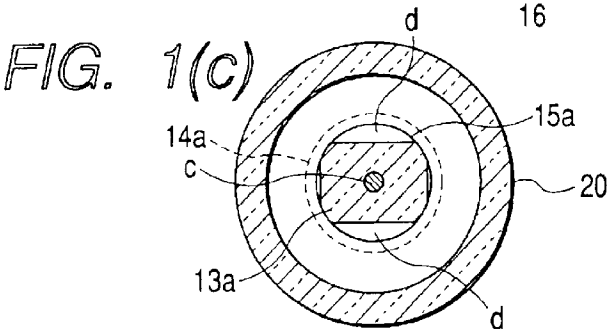

As shown in FIG. 1, the arc tube is configured in a manner such that a cylindrical shroud glass 20 for shielding ultraviolet rays is welded on and integrated with an arc tube main body 10 having a sealed glass bulb 12 which serves as a discharge portion and is formed at a portion of the main body along the longitudinal direction thereof, and the sealed glass bulb 12 is covered by the shroud glass 20.

The arc tube main body 10 is configured in a rod shape such that pinch seal portions 13*a*, 13*b* formed in a rectangular shape in its cross section are formed at the front and rear ends of the sealed glass bulb 12, and cylindrical portions 14*a*, 14*b* serving as non-pinch seal portions are formed at the front and rear ends of the pinch seal portions 13*a*, 13*b* so as to be extended therefrom, respectively.

Within the sealed glass bulb 12 sealed up by the pinch seal portions 13*a*, 13*b*, electrodes a and a are disposed in an opposite manner, and starting rare gas, mercury and metal halide (hereinafter referred to as luminescent material) are sealed. Lead wires c, c coupled to molybdenum foils b, b are extracted from the pinch seal portions 13*a*, 13*b* at the both ends of the sealed glass bulb 12, and the lead wires c, c passing through cylindrical portions 14*a*, 14*b* extend to the front and rear portions of the arc tube main body 10, respectively.

A circular flange portion 16 for welding the rear end portion 20*b* of the shroud glass 20 is formed at the outer periphery of the cylindrical portion 14*b* on the rear end side of the arc tube main body 10. Also, a shrink seal portion 15*a* having a circular shape in its cross section for welding the front end portion 20*a* of the shroud glass 20 is formed between the pinch seal portion 13*a* and the cylindrical portion 14*a* on the front end side of the arc tube main body 10.

The rear end portion of the shroud glass 20 is welded to the circular flange portion 16 of the arc tube main body 10 and the front end portion 20*a* of the shroud glass 20 is welded from the shrink seal portion 15*a* having the circular shape in its cross section to the cylindrical portion 14 of the arc tube main body 10 thereby to form a sealed space 24 isolated from the atmosphere around the arc tube main body 10 (the sealed glass bulb 12).

Figure 8A:
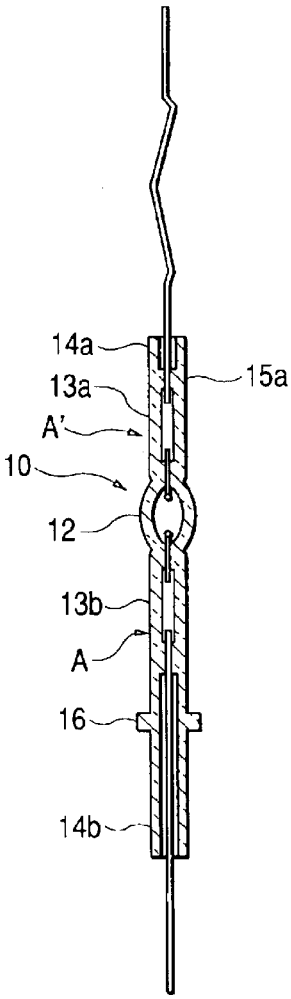
FIGS. 8(*a*)–8(*c*) are diagrams for explaining a shroud glass welding process.
Figure 8B:
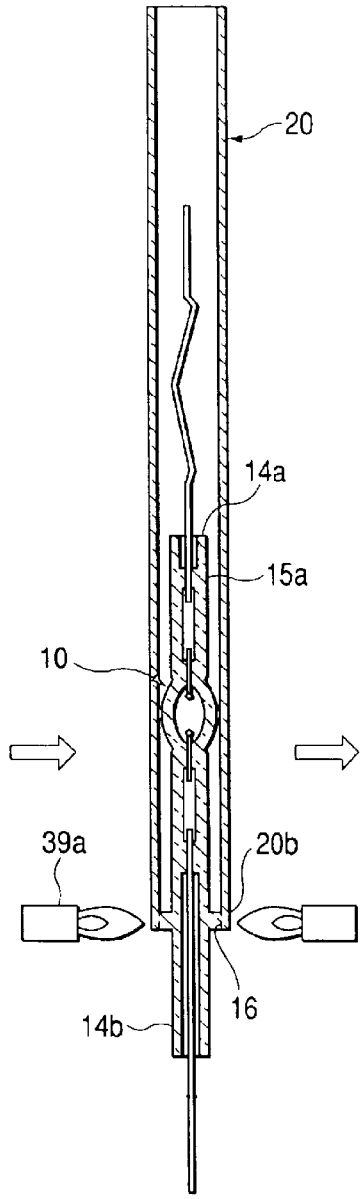
Figure 8C:
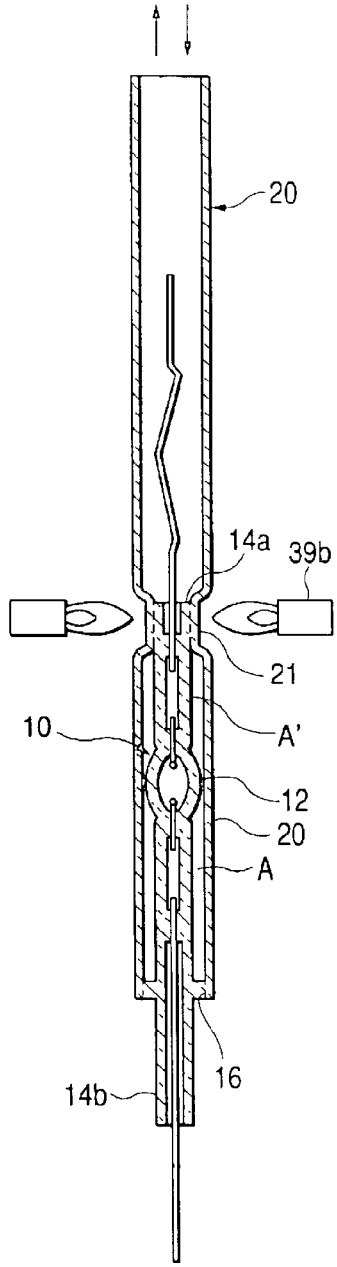

As shown in FIG. 1 and FIG. 8(*b*), since the welded portion on the rear end side of the shroud glass 20 may be welded to the circular flange portion 16 disposed closely to the inside of the rear end portion of the shroud glass tube 20, the rear end portion of the shroud glass bulb having been heated, molten and softened is molten and welded without forming any opening to the circular flange portion 16 on the inside of the bulb.

Figure 9A:
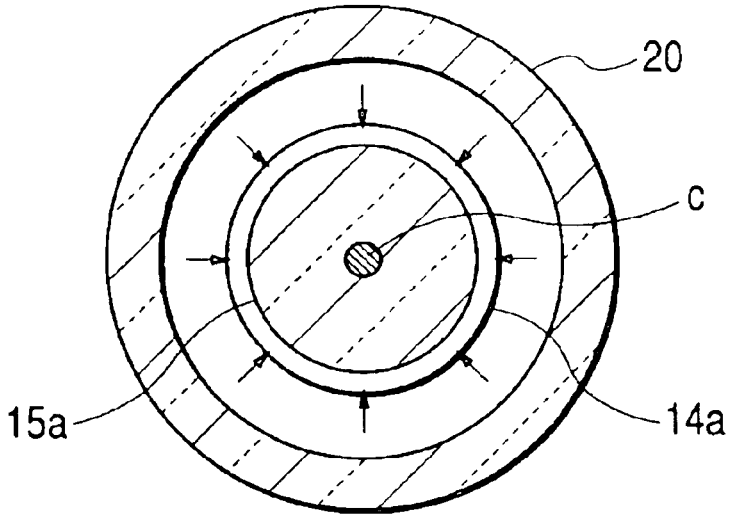
FIGS. 9(*a*) and 9(*b*) are sectional views for explaining a state where a shroud glass tube is shrink-sealed.
Figure 9B:
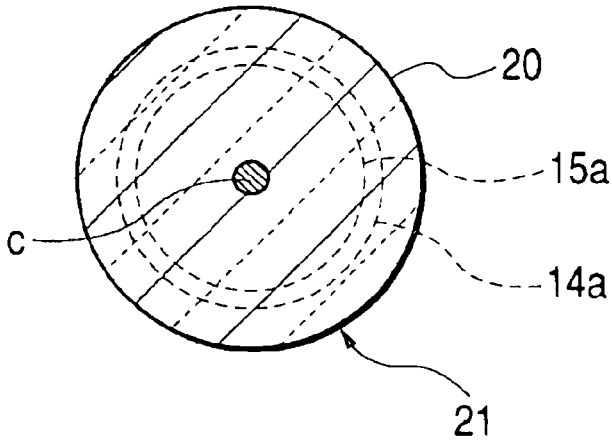

When negative pressure is applied within the shroud glass tube 20 as shown by arrows in FIG. 8(*c*) and FIG. 9(*a*), the welding area of the shroud glass tube 20 having been heated, molten and softened deforms and shrinks in a direction for reducing the diameter thereof due to the negative pressure within the bulb. Thus, as shown in FIG. 9(*b*), the welding portion on the front end side of the shroud glass tube 20 is molten and welded without forming any space from the shrink seal portion 15*a* having the circular shape in its cross section to the outer periphery of the cylindrical portion 14 on the front end side of the arc tube main body 10.

Figure 7A:
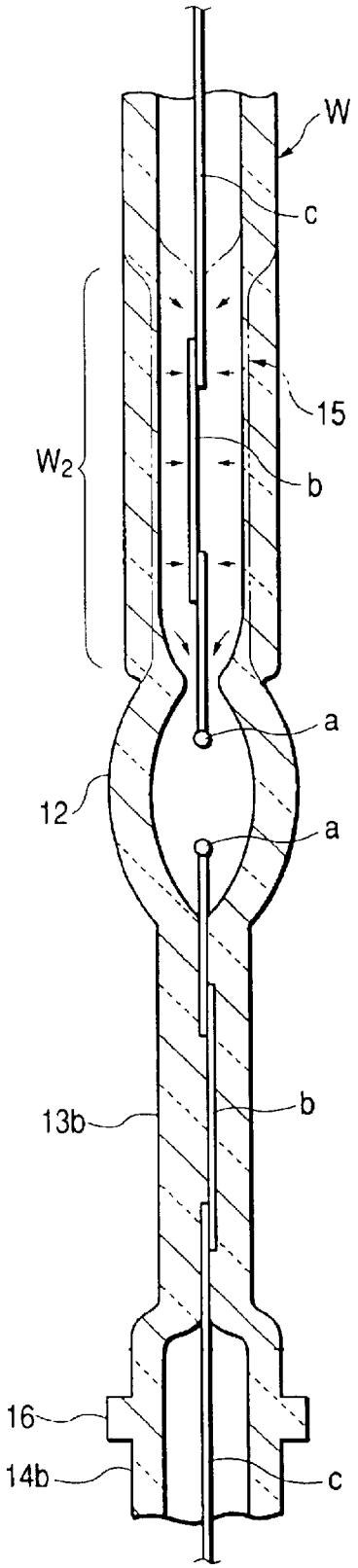
FIGS. 7(*a*) and 7(*b*) present an enlarged diagram for explaining the shrink seal action in the secondary pinch seal process.
Figure 7B:
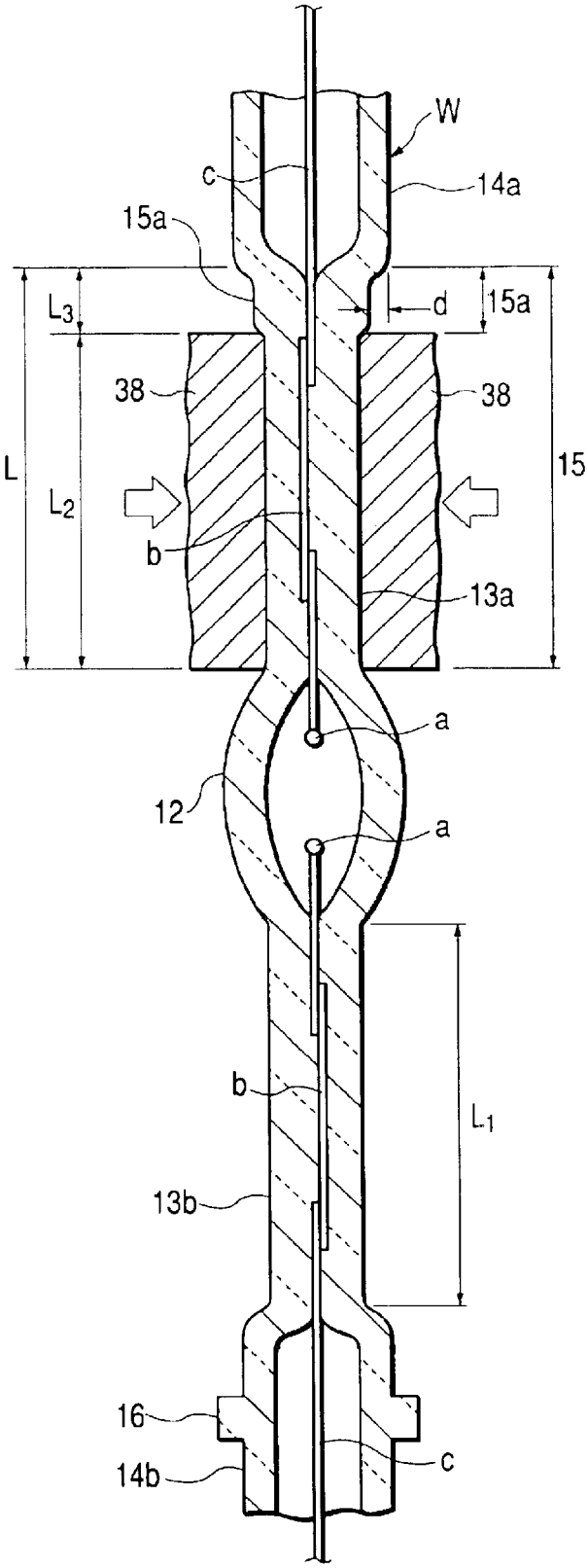

Although a step d is formed as shown in FIG. 1(*c*) and FIG. 7(*b*) between the shrink seal portion 15*a* having the circular shape in its cross section and the cylindrical portion 14*a* which are the shroud glass welded portions on the arc tube main body 10 side, since this step d has a gently tapered shape with a circular shape in its cross section, a space caused by the step d can not be formed at the welded surface between the shroud glass 20 and the arc tube main body 10.

Dry gas (for example, argon gas formed by exhausting atmosphere and minimizing moisture density) may be sealed within the sealed space 24, and the pressure within the sealed space 24 may be adjusted so as to be about 1 atm upon lighting the arc tube at which temperature becomes high and to be about 0.5 atm upon non-lighting (normal temperature). Thus, since the heat insulation sealed space 24 having little moisture is guaranteed in its airtightness, devitrificationis not generated at the arc tube.

Figure 2:
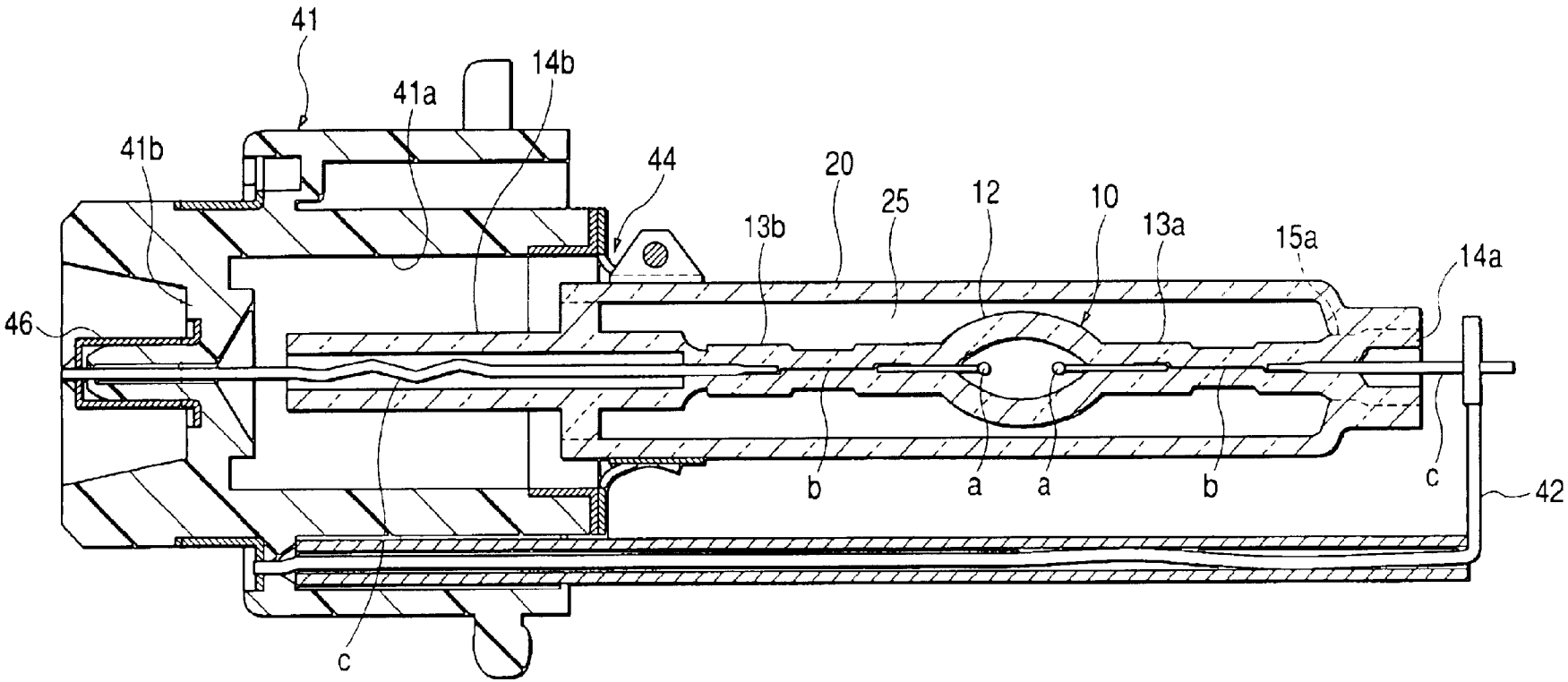
FIG. 2 is a longitudinal sectional view of a discharge lamp to which the arc tube is applied.

FIG. 2 shows a discharge lamp using an embodiment of the arc tube shown in FIG. 1. The discharge lamp is configured in a manner such that the front end portion of the arc tube is supported by a lead support 42 protruding at the forward portion of an insulative base 41, then the rear end portion of the arc tube is supported by the concave portion 41*a* of the insulative base 41, and a portion of the arc tube closer to the rear end portion thereof is held by a metal supporting member 44 fixed by the front surface of the insulative base 41.

The front end side lead wire c extracted from the arc tube is fixed to the lead support 42 by the welding. On the other hand, the rear end side lead wire c passes through a bottom surface wall 41*b* formed at the concave portion 41*a* of the insulative base 41 and fixed by the welding to a terminal 46 provided at the bottom surface wall 41*b*.

At the time of fabricating the arc tube shown in FIG. 1, first, the rod-shaped body 10 provided with the sealed glass bulb 12 is fabricated according to the arc tube main body fabricating process. Then, the shroud glass 20 for shielding ultraviolet rays is welded on and integrated with the arc tube main body 10 according to the shroud glass welding process.

Figures 5A, 5B, 5C, 5D, 5E:
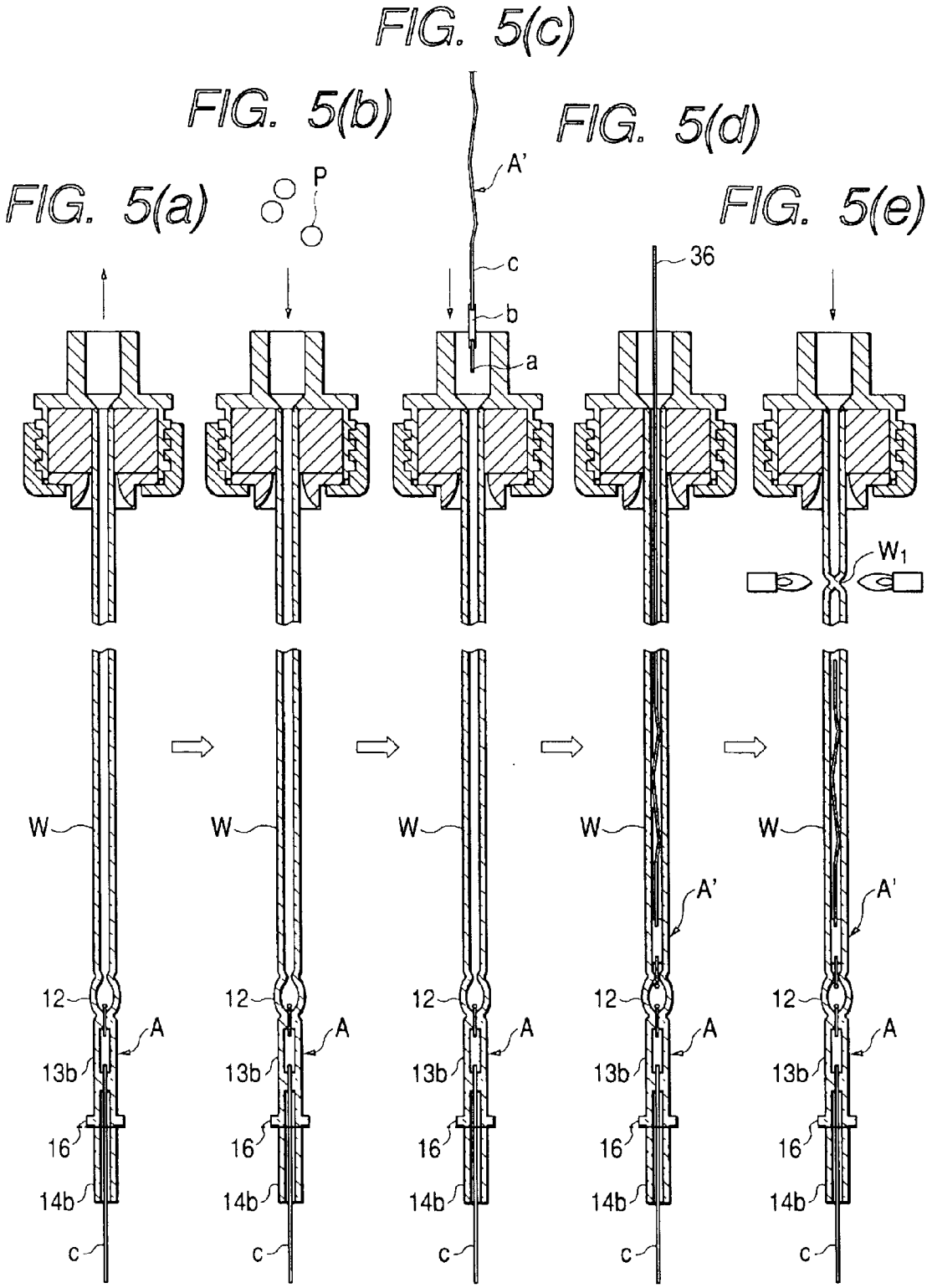
FIGS. 5(*a*)–5(*e*) are diagrams for explaining a sealing and exhausting process.
Figure 6:
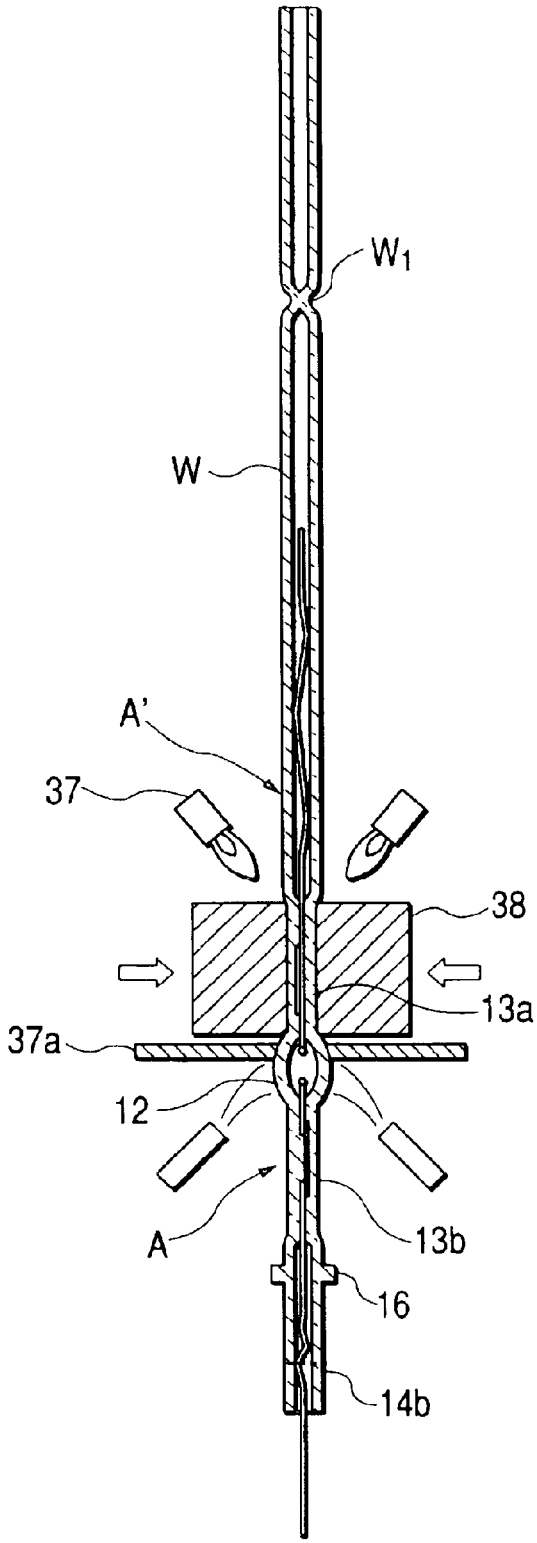
FIG. 6 is a diagram for explaining a secondary pinch seal process.

A description of the arc tube main body fabricating process is as follows. The arc tube main body fabricating process may include a glass bulb forming process as shown in FIG. 3, a primary pinch seal process as shown in FIG. 4, a sealing and exhausting process as shown in FIG. 5, and secondary pinch seal process as shown in FIGS. 6 and 7.

Figure 3A:
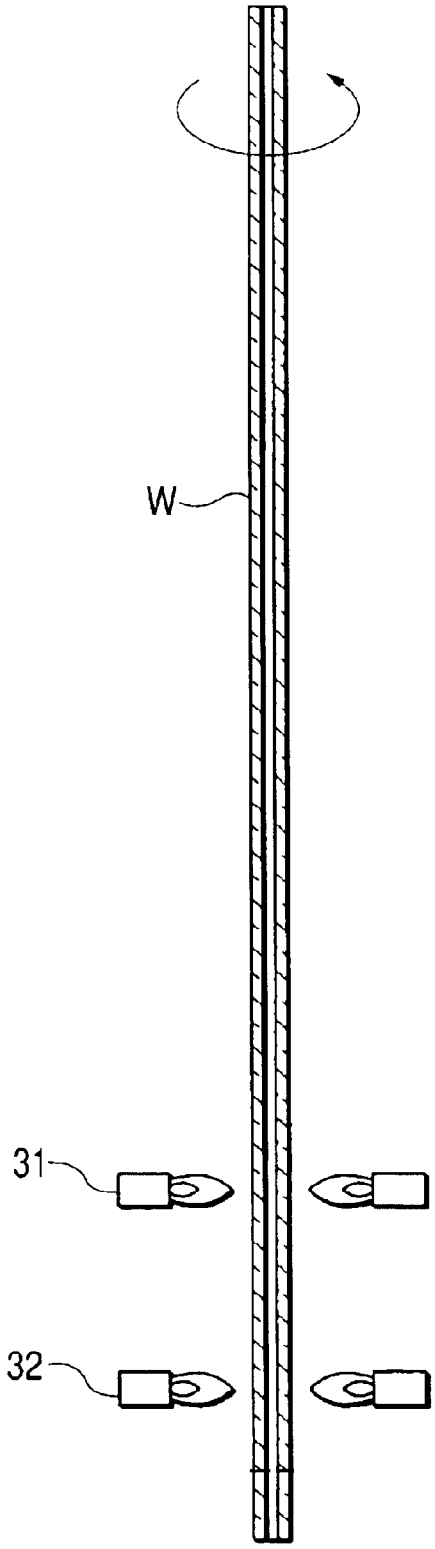
FIGS. 3(*a*) and 3(*b*) are diagrams for explaining a glass bulb forming process.
Figure 3B:
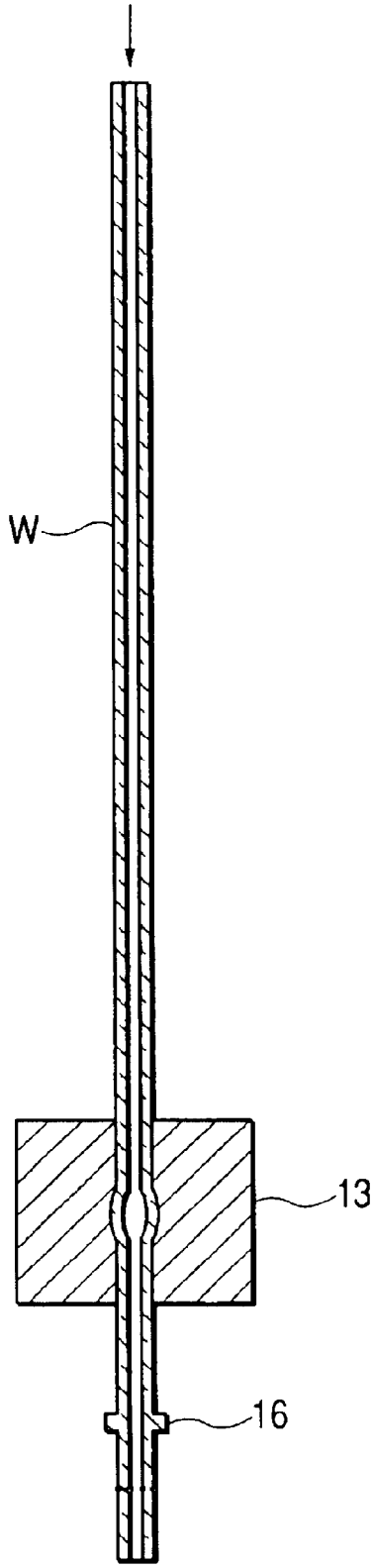

In the glass bulb forming process shown in FIGS. 3(*a*) and 3(*b*), the predetermined areas of a circular-pipe shaped silica glass tube Ware heated, molten and softened by using a heating source, such as for example, burners 31, 32 while rotating the silica glass tube around the shaft thereof, and then one of the predetermined areas may be scratched to form the circular flange portion 16 at a portion of the glass tube W closer to the open end thereof and further the sealed glass bulb 12 is formed at the other of the predetermined areas of the glass tube W by blow forming. A reference numeral 13 depicts a forming mold.

Figure 4A:
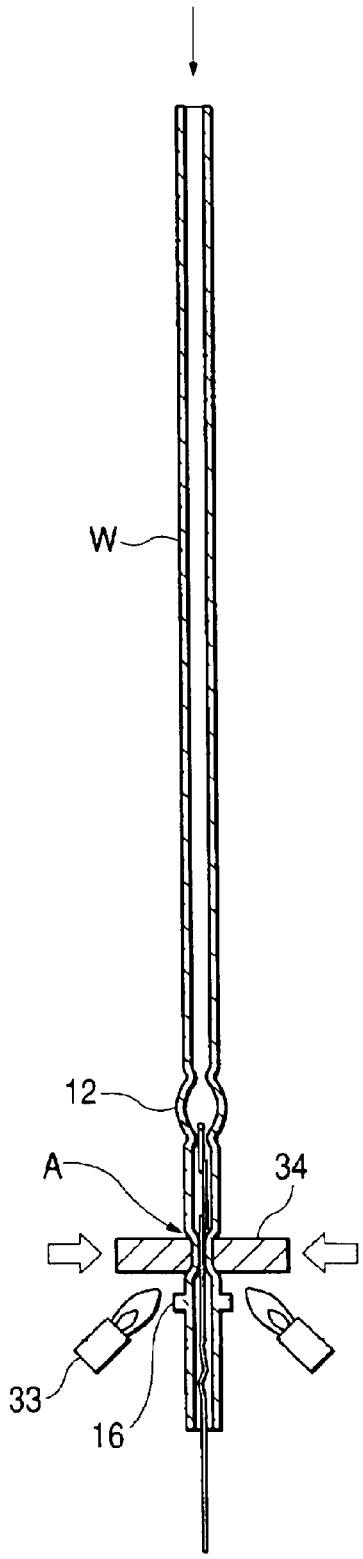
FIGS. 4(*a*) and 4(*b*) are diagrams for explaining a primary pinch seal process.
Figure 4B:
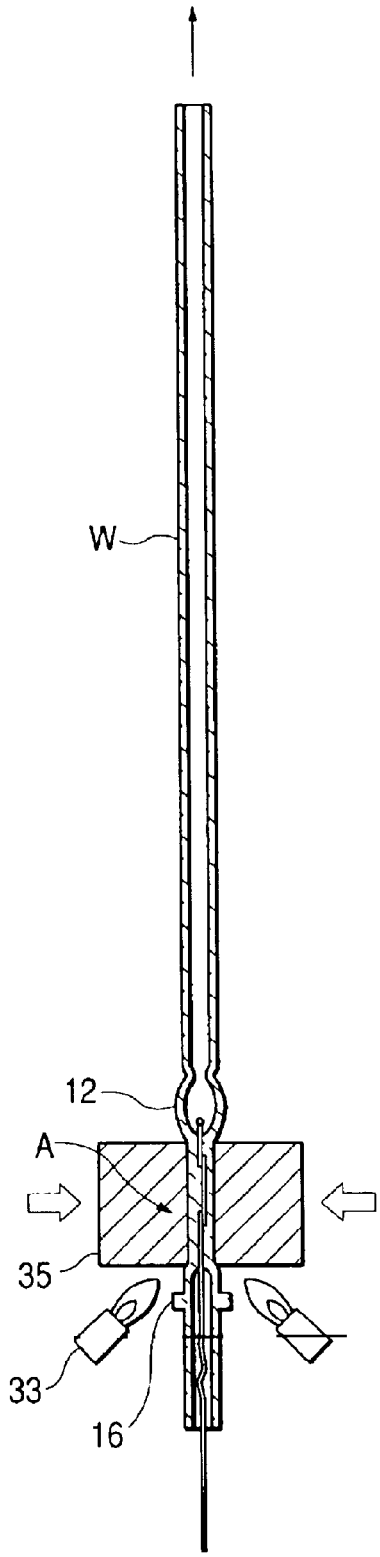

In the primary pinch seal process shown in FIGS. 4(*a*) and 4(*b*), an electrode assembly A maybe formed by integrally coupling the electrode rod a, the molybdenum foil b and the lead wire c. The electrode assembly A is inserted within the glass tube W set up vertically from the lower open end side thereof and held at the predetermined position. Further, a position of the glass tube near the sealed glass bulb 12 having been heated, molten and softened by using the burner 33 is pinch-sealed (primary pinch seal)

The primary pinch seal is performed in the following manner. First, as shown in FIG. 4(*a*), a portion closer to the circular flange portion 16 which is a pinch-seal expected area is provisionally pinch-sealed by a pincher 34 with a narrow width while supplying a gas, for example, antioxidant gas, within the glass tube from the upper opening end of the glass tube W. At the time of provisionally pinch-sealing, the antioxidant gas supplied within the glass tube W holds within the glass tube W upon pinch-sealing in an over-pressure state and suppresses the oxidization of the electrode assembly A.

Next, as shown in FIG. 4(*b*), the pressure within the glass tube W is held in a vacuum state (a pressure equal to or less than 400 Torr) by a vacuum pump (not shown), and a pinch seal expected area including the provisional pinch seal portion heated and softened by the burner 33 is entirely pinch-sealed by a wide pincher 35.

The degree of vacuum acting within the glass tube W that the inventors have found most effective is in a range of 400 Torr to $4\times10^{-3}$ Torr. In particular, prior to the formal pinch-sealing by using the pincher 35, the pinch seal expected area having been softened is shrink-sealed by the negative pressure acting within the glass tube W and thereafter further pinch-sealed by the pincher 35. Thus, the degree of adhesion of the glass layer at the rear end side pinch seal portion to the electrode assembly A is very high.

The sealing and exhausting process is shown in FIG. 5. First, the gas within the glass tube W is replaced by inactive gas, then the gas within the tube is exhausted from the upper opening end side of the glass tube W as shown in FIG. 5(*a*), and luminescent material P such as mercury, metal halide etc. is supplied within the sealed glass bulb 12 as shown in FIG. 5(*b*). As shown in FIGS. 5(*c*) and 5(*d*), another electrode assembly A' formed by integrally coupling the electrode rod a, the molybdenum foil b and the lead wire c is inserted within the glass tube and held at the predetermined position. A reference numeral 36 depicts an auxiliary member for holding and inserting the lead wire c of the electrode assembly A' within the glass tube W. The lead wire c is provided with a W-shaped bending portion at a portion along the longitudinal direction thereof. The bending portion is provided in a state being urged against the inner peripheral surface of the glass tube W, whereby the electrode assembly A' is positioned and held at the predetermined position along the longitudinal direction thereof within the glass tube W.

As shown in FIG. 5(*e*), when an upper luminescent material, etc. is sealed.

In the secondary pinch seal process, without making the pressure within the glass tube W at a negative pressure by using a vacuum pump like the formal pinch sealing of the primary pinch seal process (see FIG. 4(*b*)), the pressure within the glass tube W (glass bulb 12) may be held at a negative pressure (about 400 Torr) by condensing the luminescent material, etc. sealed within the glass tube W. Thus, as shown in FIGS. 7(*a*) and 7(*b*), the seal expected area W2 of the glass tube W having been heated, molten and softened by using the burner 37 is shrink-sealed by the negative pressure within the tube prior to the secondary pinch sealing using the pincher 38. That is, as shown by a phantom line in FIG. 7(*a*), the seal expected area W2 having been heated, molten and softened deforms and shrinks in a direction for reducing the diameter thereof by the negative pressure within the glass tube W thereby to form a shrink seal portion 15 having a circular shape in its cross section between the sealed glass bulb 12 and the cylindrical portion 14*a*. Then, when the pincher 38 pinch-seals the sealed glass bulb 12 side of the predetermined portion of the glass tube W is tipped off while supplying xenon gas within the glass tube W, the luminescent material, etc. is sealed within the tube. A reference numeral W1 depicts the tip-off portion.

Thereafter, as shown in FIG. 6, while the sealed glass bulb 12 is cooled by liquid nitrogen ($LN_2$) to condense the luminescent material, etc. as filled material thereby to maintain the pressure within the sealed glass bulb 12 at a negative pressure, the pinch seal expected area is heated to approximately 2100° C. by using a burner 37 and molten and softened, and then the sealed glass bulb 12 side of the seal expected area is pinch-sealed (secondary pinch seal) by using a pincher 38 with a predetermined width thereby to seal the sealed glass bulb 12. A reference numeral 37*a* depicts a heat shield plate. When the glass tube W is cut at a predetermined position of the cylindrical portion 14*a* serving as a non-pinch seal portion continuing to the secondary pinch seal portion 13*a*, the arc tube main body 10 can be completed that has the sealed glass bulb 12 wherein the electrodes a and a are provided in an opposite manner and the shrink seal portion 15 by a width (length) L2, the shrink seal portion 15*a* having the circular shape in its cross section and a width (length) L3 is formed adjacent to the pinch seal portion 13*a*. The portion between the shrink seal portion 15*a* and the cylindrical portion 14*a* is configured in a tapered shape as shown in FIGS. 1(*a*), 1(*b*) and 1(*c*) in a manner that the outer diameter thereof increases gradually toward the cylindrical portion 14*a* from the shrink seal portion 15*a*.

On the secondary pinch seal side, the seal expected area W2 is not entirely pinch-sealed unlike the primary pinch seal side, but as shown in FIG. 7(*b*) the width (length) L2 of the secondary pinch seal portion 13*a* is shorter than the width (length) L1 of the primary pinch seal portion 12*b* by the width (length) L3 of the exposed shrink seal portion 15*a*. However, since the entire area of a seal expected area W3 is shrink-sealed and the shrink seal portion 15 may be pinch-sealed along, for example, almost 70% of the entire length thereof, the degree of adhesion of the secondary pinch seal portion 13*a* to the electrode assembly A' of the glass layer (the electrode rod a, the molybdenum foil b and the lead wire c) is very high.

The width (length) L3 of the exposed shrink seal portion 15*a* is desirably in a range of L/6 to L/2, where L represents the entire length (=L1) of the seal portion (that is, the pinch seal portion 13*a* and the shrink seal portion 15*a*). In one embodiment of the invention, the length of the pinch seal portion is 12 mm and the length of the exposed shrink seal portion is 5 mm. When the width (length) L3 of the exposed shrink seal portion 15*a* is too short, the welding surface of the shroud glass 20 described later extends over the pinch seal portion 13*a* having a circular shape in its cross section, so that a space is likely generated at the welding surface. Otherwise, the welding surface of the shroud glass 20 extends to the tip portion of the cylindrical portion 14*a*, so that the size of the arc tube becomes large. In contrast, when the width (length) L3 of the exposed shrink seal portion 15*a* is too long, the width (length) L2 of the pinch seal portion 13*a* becomes shorter by the longer length of the width L3, so that the degree of adhesion of the seal portion to the electrode assembly A' of the glass layer reduces and so the airtightness of the sealed glass bulb 12 can not be secured.

Next, the shroud glass welding process of the present invention will be explained using FIGS. 8 and 9.

First, the shroud glass tube 20 having an inner diameter larger than the sealed glass bulb 12 of the arc tube main body 10 is prepared. Then, as shown in FIG. 8(*b*), the arc tube main body 10 is inserted within the shroud glass tube 20 disposed in a vertical state, then the rear end portion 20*b* of the shroud glass tube 20 is heated and molten by using a burner 39*a* and welded on the circular flange portion 16 on the arc tube main body 10 side.

Then, as shown in FIG. 8(*c*), the atmosphere within the shroud glass tube 20 is forcedly exhausted, and the gas exchange is performed in a manner that dry gas (for example, argon gas formed by exhausting atmosphere and minimizing moisture density) is supplied to within the shroud glass tube 20. Further, the pressure within the tube is set at a negative pressure (for example, 0.5 atm), and the seal expected area of the shroud glass tube 20 is heated, molten and softened by using a burner 39*b* thereby to shrink seal.

That is, the welding expected area of the shroud glass tube 20 thus heated, molten and softened deforms and shrinks in the direction for reducing the diameter thereof by the negative pressure within the tube and is molten and contacts closely to the area from the shrink seal portion 15*a* having the circular shape in its cross section to the cylindrical portion 14*a* on the front end side of the arc tube main body 10 without causing any space. A reference numeral 21 in FIG. 8(*c*) depicts the shrink seal portion of the shroud glass tube 20.

As shown in FIG. 7(*b*), the outer peripheral surface of the arc tube main body 10 from the shrink seal portion 15*a* to the cylindrical portion 14*a* serving as the shroud glass welded portion is configured to have the gently tapered shape with the circular shape in its cross section although it has the step d at a portion thereof, and the inner peripheral surface of the portion on the shroud glass tube 20 side being molten, soften and reduced in its diameter is also circular. Thus, the circular inner peripheral surface of the portion on the shroud glass tube 20 side being molten, soften and reduced in its diameter is molten and contacts closely and uniformly along the peripheral direction thereof to the outer peripheral surface of the shroud glass welded potion on the arc tube main body 10 side (the outer peripheral surface from the shrink seal portion 15*a* to the cylindrical portion 14*a*) without causing any space. Accordingly, a space for releasing the sealed space 24 around the arc tube main body 10 to the atmosphere is not formed at the shrink seal portion 21 (the welding portion between the arc tube main body 10 and the shroud glass tube 20).

Finally, when the shroud glass tube 20 is cut at the position of the shrink seal portion 21, the arc tube in which the shroud glass 20 is welded on and integrated with the arc tube main body 10 can be obtained as shown FIG. 1.

In the aforesaid embodiment of the present invention, the rear end portion 20*b* of the shroud glass may be welded on the circular flange portion 16 formed at the outer periphery of the cylindrical portion 14*b* on the rear end side of the arc tube main body 10. However, like the conventional configuration, the rear end side area of the shroud glass tube having been heated, molten and softened may be reduced in its diameter by using the forming rolls etc., and directly welded on the cylindrical portion 14*b* on the rear end side of the arc tube main body.

Further, the front end portion 20*a* of the shroud glass may be welded by the shrink sealing on the shroud glass welded portion on the front end side of the arc tube main body 10 (the area from the potion 15*a* to the cylindrical portion 14*a*). However, like the conventional configuration, the predetermined area on the front end side of the shroud glass tube having been heated, molten and soften may be reduced in its diameter by using the forming rolls etc., and welded on the shroud glass welded portion on the front end side of the arc tube main body (the area from the potion 15*a* to the cylindrical portion 14*a*).

Further, in the aforesaid embodiment, the front end portion 20*a* of the shroud glass is welded to the cylindrical portion 14*a* from the shrink seal portion 15*a* which is provided adjacent to the forward portion of the pinch seal portion 13*a* of the arc tube main body 10. However, the shroud glass welded portion on the front end side of the arc tube main body 10 may be configured in the following manner.

Figure 10:
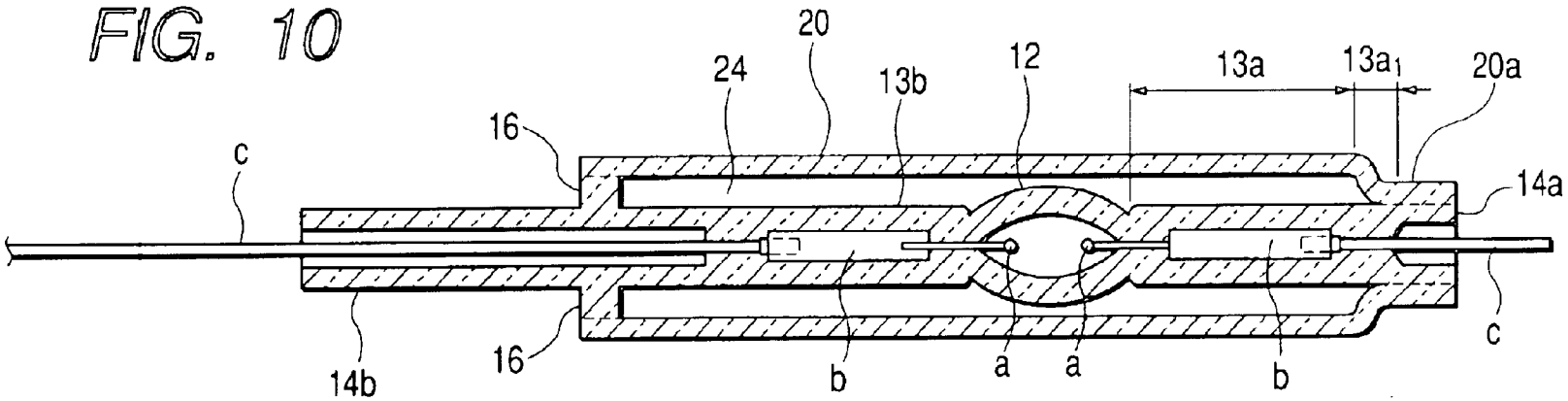
FIG. 10 is a longitudinal sectional view of an arc tube according to a second embodiment of the invention.

As shown in FIG. 10, the forming surface of the pincher for the secondary pinch seal may be configured so as to be provided with a first forming surface for forming the pinch seal portion 13*a* having a rectangular cross section and a second forming surface for forming the shroud glass welded portion having the circular cross section which corresponds to the shrink seal portion 15*a*. Thus, like the shrink seal portion 15*a* shown in FIG. 7, a tapered type pinch seal portion 13*a*1 having a circular cross section smoothly continuing to the cylindrical portion 14*a* may be formed in adjacent to the forward portion of the pinch seal portion 13*a* having the rectangular cross section, whereby the front end side of the shroud glass tube 20 may be welded on the area from the tapered type pinch seal portion 13*a*1 to the cylindrical portion 14*a*.

Figure 11:
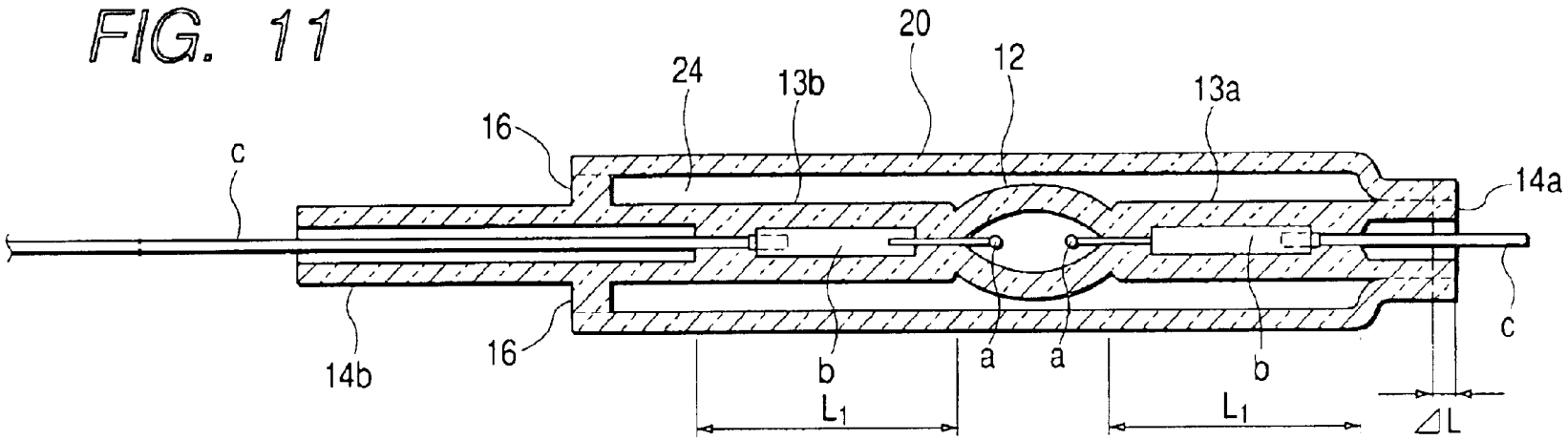
FIG. 11 is a longitudinal sectional view of an arc tube according to a third embodiment of the invention.
Figure 12:
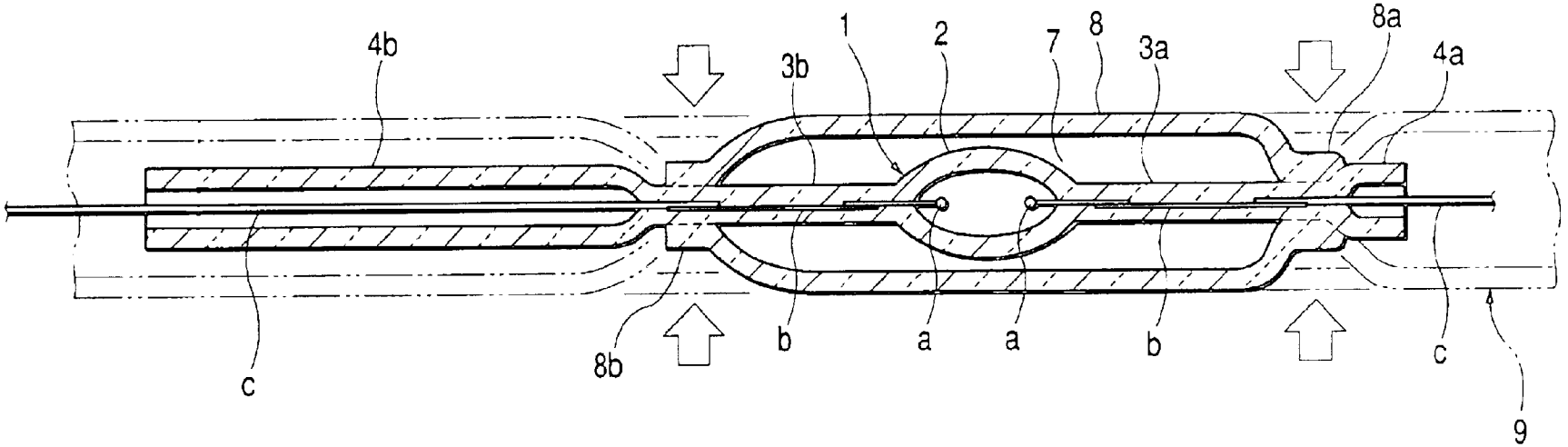
PRIOR ART FIG. 12
FIG. 12 is a longitudinal sectional view of a conventional arc tube for a discharge lamp.
Figure 13A:
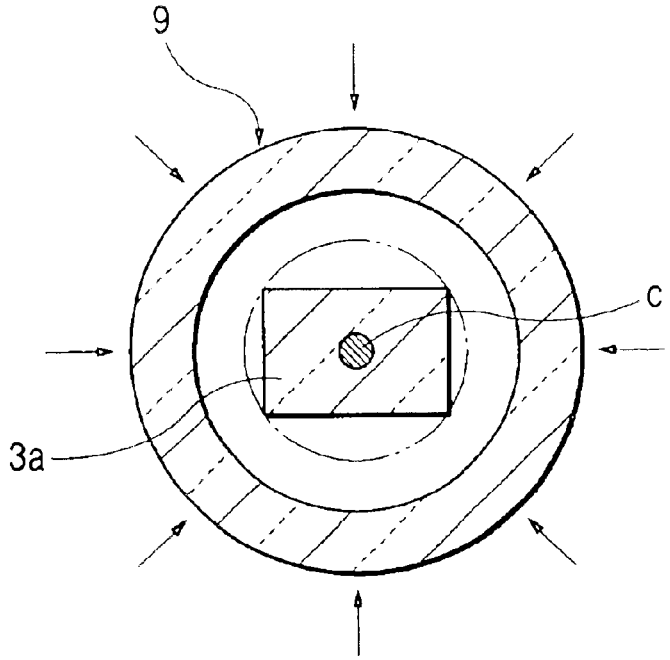
PRIOR ART FIG. 13(a)
FIGS. 13(*a*) and 13(*b*) are a diagram for explaining a state where a shroud glass is welded in the conventional arc tube fabricating process.
Figure 13B:
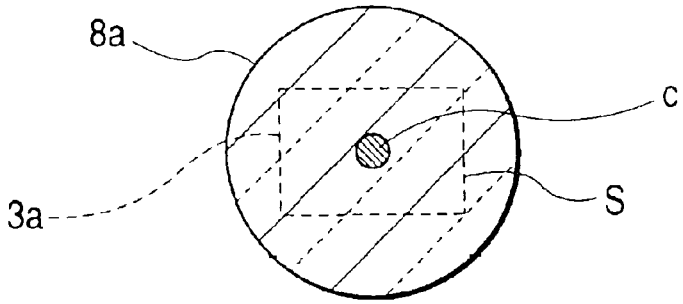
PRIOR ART FIG. 13(b)

Next, as shown in FIG. 11, the longitudinal length of the shroud glass 20, that is, the length of the arc tube becomes slightly longer (by ΔL) However, the pinch seal portion 13*a* having the rectangular cross section on the front end side of the arc tube main body may be formed to have the same length L1 as the pinch seal portion 13*b* on the rear end side, and the front end portion 20*a* of the shroud glass may be welded only on the cylindrical portion 14*a* so as not to extend to the pinch seal portion 13*a* on the front end side.

Further, the shrink seal portion 15*a* or the pinch seal portion 13*a*1 having the circular cross section may be set to be longer than that of the embodiment so that the front end portion 20*a* of the shroud glass may be welded only on the shrink seal portion 15*a* and the pinch seal portion 13*a*1 having the circular cross section.

As is clear from the aforesaid explanation, according to the present invention, since a space for releasing the sealed space around the arc tube main body to the atmosphere is not formed at the molten welded surface between the shroud glass welded portion of the arc tube main body and shroud glass, an arc tube for a discharge lamp which does not cause the devitrification phenomenon and is long in its life time can be provided.

Further, according to the preset invention, the arc tube main body can be fabricated without separately providing a new process for forming shroud glass welded portions having circular cross sections on the front and rear end sides of the arc tube main body, respectively. Thus, the arc tube main body fabricating process does not become more complicated as compared with the conventional process.

In addition, since the rear end side of the shroud glass can be welded by merely being heated and molten, the welding process and equipment for the shroud glass can be simplified.

In view of the fabrication equipment used in the method of the present invention, the shrink seal portion serving as the shroud glass welded potion can be formed on the front end side of the arc tube main body by merely replacing the tip end portion of the pincher for forming the front end side pinch seal portion, so that the fabricating cost is quite small.

Further, by making the negative pressure act within the shroud glass tube, and heating, melting and softening the shroud glass tube, the front end side of the shroud glass tube is shrink-sealed and molten and contacts closely to the circular outer peripheral surface of the shroud glass welded portion on the arc tube main body side. Thus, the process and equipment used for the present invention can be made simpler since members for welding the shroud glass such as a pincher, forming rolls, etc. are not required.

Further, since the welding length of the front end portion of the shroud glass can be made longer, the airtightness of the sealed space surrounding the arc tube main body can be further improved.

What is claimed is:

1. A method of fabricating an arc tube for a discharge lamp, including:

forming shroud joining portions with circular cross sections on front and rear end sides of an arc tube body;

inserting the arc tube body into a shroud;

heating predetermined portions of the shroud wherein the predetermined portions are modified in a direction of reducing diameters thereof as an effect of the heating; and joining the predetermined portions to the shroud joining portions on the front and rear end sides of the arc tube body, wherein the shroud joining portions include a cylindrical non-pinch seal portion provided with a circular flange portion on an outer periphery thereof in an extended manner at a backward portion of a pinch seal portion on the rear end side of the arc tube body, and the joining step includes joining the rear end side of the shroud to the circular flange portion on the rear end side of the arc tube body.

2. The method of fabricating an arc tube for a discharge lamp according to claim 1, wherein the joining step is performed by a welding process.

3. The method of fabricating an arc tube for a discharge lamp according to claim 2, wherein the predetermined portions include a front end side and a rear end side of the shroud, and wherein the rear end side of the shroud is welded to the rear end side of the arc tube body, and the front end side of the shroud is welded to the front end side of the arc tube body.

4. The method of fabricating an arc tube for a discharge lamp according to claim 1, wherein the shroud joining portions include a shrink seal portion adjacent to a forward portion of another pinch seal portion on the front end side of the arc tube body, and the joining step includes joining a front end side of the shroud to the shrink seal portion on the front end side of the arc tube body.

5. The method of fabricating an arc tube for a discharge lamp according to claim 1, further including forming the arc tube body by:

forming a bulb at a portion of a tube;

inserting a first electrode assembly from one end side of the tube provided with the bulb;

pinch-sealing a first portion of the tube between the one end side and the bulb, and near the bulb;

supplying a predetermined filling material to the bulb;

inserting a second electrode assembly from the other end side of the tube and holding the second electrode assembly at a predetermined position, supplying an inactive gas within the bulb;

pinch-sealing or tipping off a second portion of the tube near the other end side of the tube to seal the inactive gas within the tube; and pinch-sealing a third portion of the tube between the other end side and the bulb, and near the bulb.

6. The method of fabricating an arc tube for a discharge lamp according to claim 5, wherein prior to pinch-sealing of the third portion of the tube between the other end side and the bulb, and near the bulb, a seal expected area near the bulb is heated and molten to perform shrink sealing to form a shrink seal portion while cooling the bulb with a cooling medium, and thereafter, during the pinch-sealing, a bulb side of the shrink seal portion is pinch-sealed with a predetermined width, thereby forming the pinch seal portion in the third portion of the tube adjacent to the shrink seal portion.

7. The method of fabricating an arc tube for a discharge lamp according to claim 6, wherein a negative pressure is maintained within the shroud while a rear end side of the shroud is joined to the rear end side of the arc tube body by welding, a welding expected area on a front end side of the shroud is heated, molten and softened, and a front end side of the shroud is shrink-sealed to the shrink seal portion adjacent to the pinch seal portion.

8. A method of fabricating an arc tube for a discharge lamp, including:

forming shroud joining portions with circular cross sections on front and rear end sides of an arc tube body;

inserting the arc tube body into a shroud;

heating predetermined portions of the shroud wherein the predetermined portions are modffied in a direction of reducing diameters thereof as an effect of the heating; and joining the predetermined portions to the shroud joining portions on the front and rear end sides of the arc tube body, wherein the shroud joining portions include a cylindrical non-pinch seal portion in an extended manner at a backward portion of a first pinch seal portion on the rear end side of the arc tube body, and a shrink seal portion adjacent to a forward portion of a second pinch seal portion on the front end side of the arc tube body, and the joining step includes joining a rear end side of the shroud to the cylindrical non-pinch seal portion on the rear end side of the arc tube body, and joining a front end side of the shroud to the shrink seal portion on the front end side of the arc tube body, and wherein the cylindrical non-pinch seal portion includes a circular flange portion on an outer periphery, and the rear end side of the shroud is joined to the circular flange portion on the rear end side of the arc tube body.

9. A method of fabricating an arc tube for a discharge lamp, including:

forming shroud joining portions with circular cross sections on front and rear end sides of an arc tube body;

inserting the arc tube body into a shroud;

heating predetermined portions of the shroud wherein the predetermined portions are modified in a direction of reducing diameters thereof as an effect of the heating; and joining the predetermined portions to the shroud joining portions on the front and rear end sides of the arc tube body, wherein the shroud joining portions include a cylindrical non-pinch seal portion provided with a circular flange portion on an outer periphery thereof in an extended manner at a forward portion of a pinch seal portion on the front end side of the arc tube body, and the joining step includes joining a front end side of the shroud to the cylindrical non-pinch seal portion on the front end side of the arc tube body, or to a circular cross-sectional portion of the front end side that includes the cylindrical non-pinch seal portion.

* * * * *